United States Patent [19]

Grise

[11] Patent Number: 4,814,586

[45] Date of Patent: Mar. 21, 1989

[54] ELECTRICAL RESISTANCE HEATER

[76] Inventor: Frederick G. J. Grise, P.O. Box 186, Osterville, Mass. 02655

[21] Appl. No.: 34,015

[22] Filed: Apr. 2, 1987

Related U.S. Application Data

[60] Division of Ser. No. 674,698, Nov. 26, 1984, Pat. No. 4,656,339, which is a division of Ser. No. 295,000, Aug. 21, 1981, Pat. No. 4,485,297, which is a continuation-in-part of Ser. No. 181,974, Aug. 28, 1980, abandoned.

[51] Int. Cl.[4] ..... H05B 3/36

[52] U.S. Cl. ..... 219/549; 219/528; 219/553; 338/308

[58] Field of Search ..... 219/549, 548, 528, 529, 219/535, 552, 553, 345, 527; 338/293, 328, 211, 212, 308, 309, 314

[56] References Cited

U.S. PATENT DOCUMENTS

| | | | |
|---|---|---|---|
| 2,475,379 | 7/1949 | Stong | 338/309 |
| 2,629,166 | 2/1953 | Marsten | 338/309 |
| 3,257,498 | 6/1966 | Kahn | 219/535 |
| 3,296,574 | 1/1967 | Tassara | 338/309 |
| 3,627,981 | 12/1971 | Kuhn | 219/528 |
| 3,813,519 | 5/1974 | Jochim | 338/309 |
| 3,878,362 | 4/1975 | Stinger | 219/528 |
| 4,137,447 | 1/1979 | Bodz | 338/309 |
| 4,429,216 | 1/1984 | Brigham | 219/548 |

*Primary Examiner*—Teresa J. Walberg

[57] ABSTRACT

The heater includes a paper or plastic substrate on which is printed a semi-conductor pattern (typically a colloidal graphite ink) having (a) a pair of longitudinal stripes extending parallel to and spaced apart from each other and (b) a plurality of identical bars spaced apart from each other and extending between and electrically connected to the stripes. A metallic conductor (typically copper stripping) overlies each of the longitudinal stripes in face-to-face engagement therewith, and the conductors are held in tight engagement with the stripes by a sealing layer that overlies the metallic conductors and is sealed, at opposite sides of the semi-conductor stripe associated with the particular metallic conductor, to portions of the substrate that are free from the printed semi-conductor pattern.

13 Claims, 3 Drawing Sheets

FIG 4A
130 watts/m
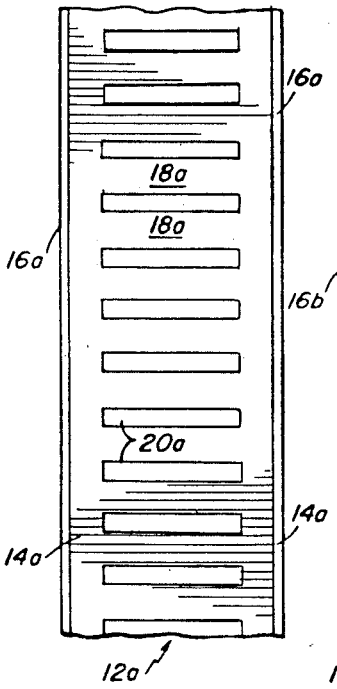
FIG 4B
65 watts/m
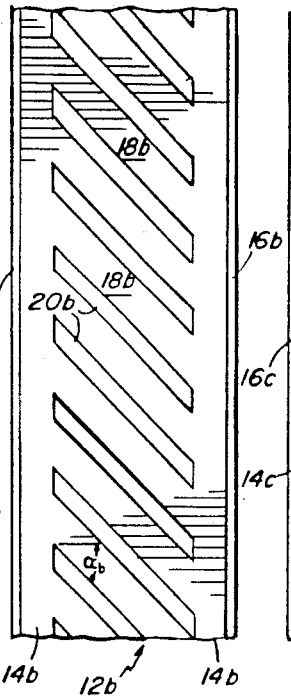
FIG 4C
32.5 watts/m
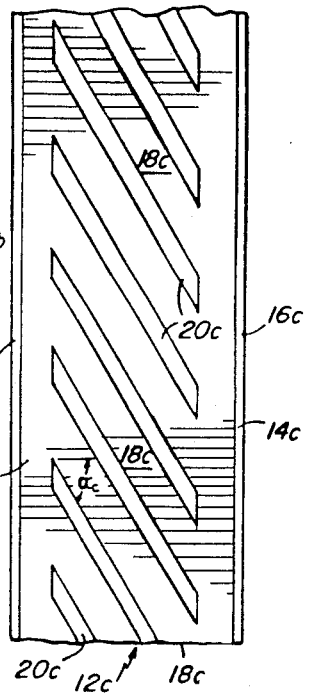
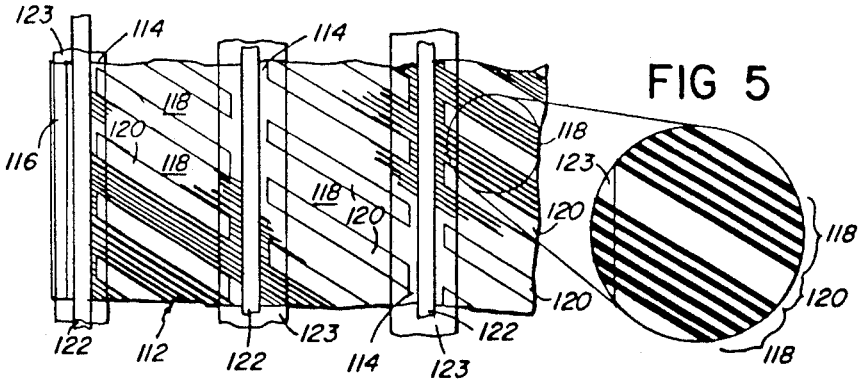
FIG 5
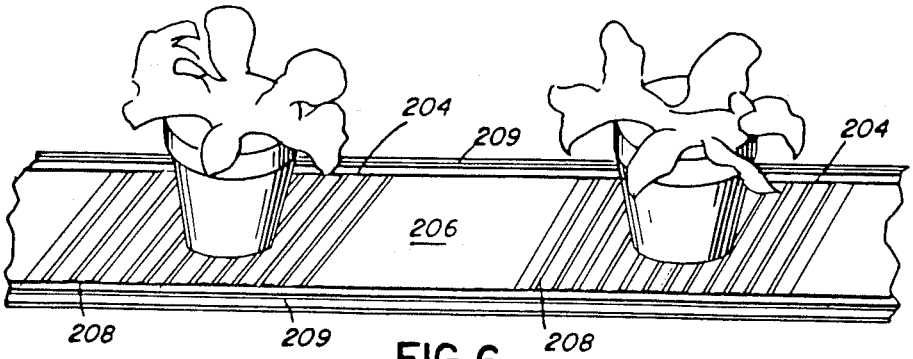
FIG 6

ELECTRICAL RESISTANCE HEATER

CROSS-REFERENCE TO RELATED APPLICATIONS

This application is a division of U.S. Patent Application Ser. No. 674,698, filed Nov. 26, 1984 and now U.S. Pat. No. 4,656,339, which itself is a division of U.S. Patent Application Ser. No. 295,000, filed Aug. 21, 1981 and now U.S. Pat. No. 4,485,297, which itself is a continuation-in-part of U.S. Pat. Application Ser. No. 181,974, filed Aug. 28, 1980 and now abandoned.

BACKGROUND OF THE INVENTION

Many electric heating tapes have been made in the past, most include thin-wire or etched foil heaters and are specifically designed to produce a specific wattage over a predetermined length. Such tapes are generally fairly expensive; it is difficult to vary their watt density; and many cannot be used in wet or damp environments.

SUMMARY OF THE INVENTION

The present invention provides a flexible continuous sheet heater having a high uniformity in heat propagation that can replace existing thin-wire and etched foil heaters in a fraction of the cost of the existing devices. It is relatively inexpensive to produce, can be used in a wet or damp environment, has a constant watt density per unit length, and is so designed that the watt density can be varied within wide limits.

In general, the heater of the present invention includes a paper or plastic substrate on which is printed a semi-conductor pattern (typically a colloidal graphite ink) having (a) a pair of longitudinal stripes extending parallel to and spaced apart from each other and (b) a plurality of identical bars spaced apart from each other and extending between and electrically connected to the stripes. A metallic conductor (typically copper stripping) overlies each of the longitudinal stripes in face-to-face engagement therewith, and the conductors are held in tight engagement with the stripes by a sealing layer that overlies the metallic conductors and is bonded, at opposite sides of the semi-conductor stripe associated with the particular metallic conductor, to portions of the substrate that are free from the printed semi-conductor pattern.

In many preferred embodiments, the substrate, semi-conductor pattern and metallic conductors are hermetically sealed between a pair of plastic sheets. One sheet is positioned on each side of the substrate and the edges of the sheets extend beyond the sides of the substrate and are heat sealed together.

The wattage per unit length (watt density) of the heater is uniform regardless of the overall length of the heater, and any desired length can be cut off a reel and used as desired. Further, without changing either the semi-conductor material, or the thickness or width of the printed bars of the semi-conductor pattern, the watt density of the heater may be varied widely simply by changing the angle between the longitudinal stripes and the bars.

The heater of the instant invention can be made in either sheet (of any desired length and width) or tubular form. Typical uses include area (e.g., wall or floor) heaters, pizza box heaters, thin heaters for pipes, wide heaters for under desks and tables, spaced heaters for greenhouse plant use, and cylindrical hose-shaped heaters.

BRIEF DESCRIPTION OF THE DRAWINGS

FIGS. 4A, 4B and 4C are simplified views illustrating changes in watt density.

FIG. 5 is a plan view of a modification of the heater of FIG. 1.

FIG. 6 is a perspective view of a second modification of the heater of FIG. 1.

DETAILED DESCRIPTION OF PREFERRED EMBODIMENTS

Figure 1:
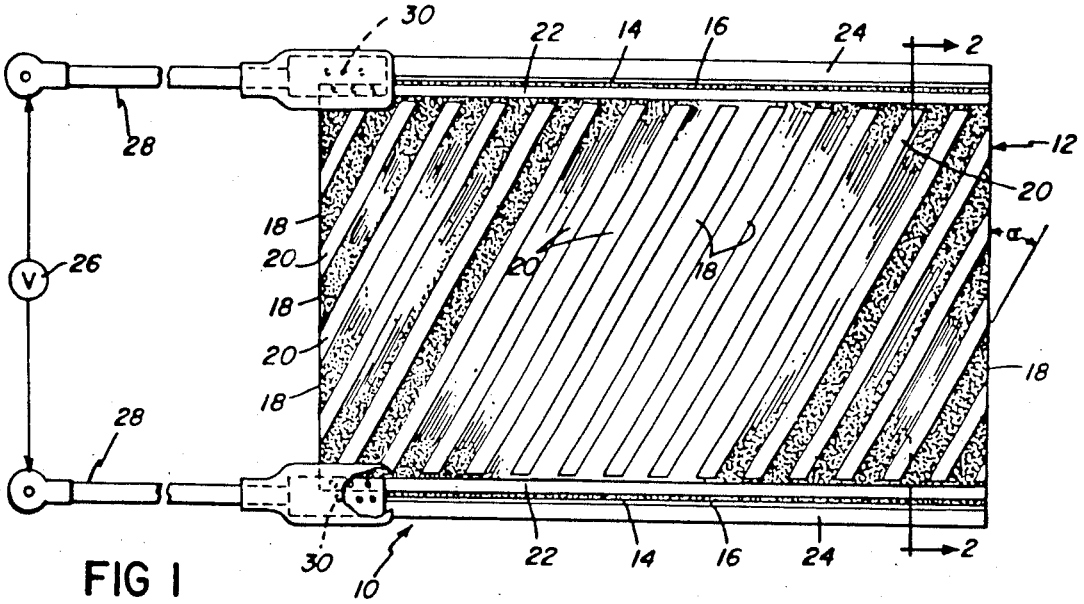
FIG. 1 is a plan view of a heater embodying the present invention, with the top layer removed for clarity.
Figure 2:
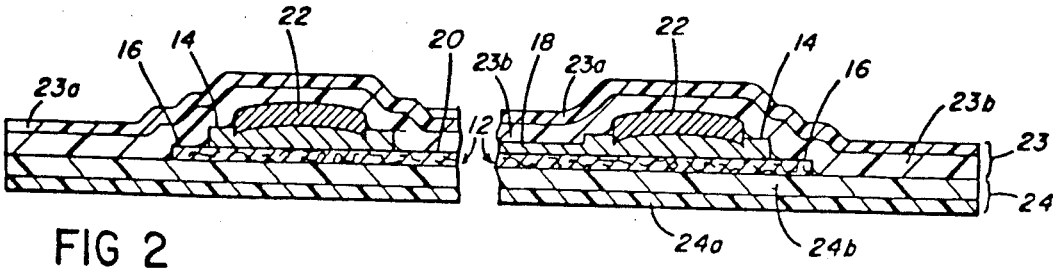
FIG. 2 is a section taken of 2—2 of FIG. 1.
Figure 3:
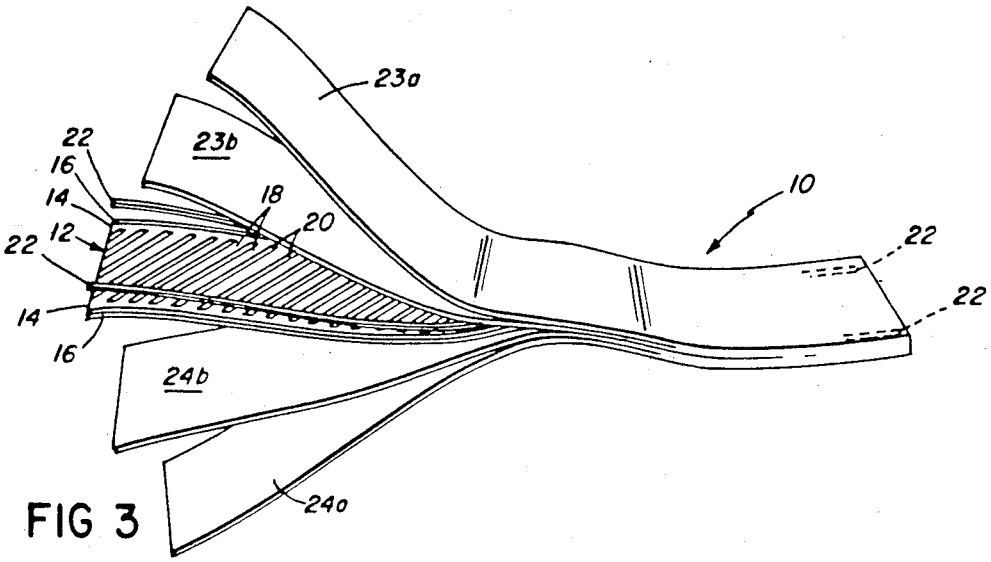
FIG. 3 is a partially exploded view of the heater of FIG. 1.

Referring now to FIGS. 1–3, there is shown a length of an electrical heater generally designated 10, comprising a paper substrate 12 on which is printed, typically by silk-screening, a semi-conductive pattern of colloidal graphite. The graphite pattern includes a pair of parallel longitudinal stripes 14. Each stripe is 0.397 cm. (5/32 in.) wide and the inner edges of the stripes are 8.7 cm. (3 7/16 in.) apart. The overall width of the graphite pattern, thus, is 9.525 cm. (3 3/4 in.); and the substrate 12 on which the pattern is centered is of sufficient width (nominally about 10 cm. or 4 in.) to leave a 0.08 cm. (1/32 in.) to about 0.64 cm. ($\frac{1}{4}$ in.) uncoated boundary 16 along each edge.

The graphite pattern includes also a plurality of identical regularly-spaced semi-conductor bars 18 extending between stripes 14. Each bar 18 is 0.64 cm. ($\frac{1}{4}$ in.) wide (measured perpendicular to its edges) and the space bar 20 between adjacent bars (i.e., the unprinted area or "white" space) is 0.32 cm. ($\frac{1}{8}$ in.) wide. As shown, all of bars 18 extend in straight lines and form an angle, designated $\alpha$, of 30° with a line extending perpendicularly between stripes 14. Since bars 18 are twice as wide as the spaces 20 between them, 66 $\frac{2}{3}$ per cent of the area between stripes 14 is coated with semi-conductor material.

In this and other preferred embodiments, the material forming the semi-conductor patterns of stripes 14 and bars 18 is a conductive graphite ink (i.e., a mixture of conductive colloidal graphite particles in a binder) and is printed on the paper substrate 12 at a substantially uniform thickness (typically about 0.0025 cm. or 0.001 in. for the portion of the pattern forming bars 18 and about 0.0035 cm. or 0.0014 in. for the portions of the pattern forming stripes 14) using a conventional silk-screen process. Inks of the general type used are commercially available from, e.g., Acheson Colloidals of Port Huron, Mich. (Graphite Resistors for Silk Screening) and DuPont Electronic Materials, Photo Products Department, Wilmington, Del. (4200 Series Polymer Resistors, Carbon and Graphite Base). A similar product, Polymer Resistent Thick Films, is sold by Methode Development Co. of Chicago, Ill.

Semi-conductor materials of the type used in the present invention are also discussed in the literature, see for example U.S. Pat. Nos. 2,282,832; 2,473,183; 2,559,077; and 3,239,403. The literature teaches that such materials may be made by mixing conductive particles other than graphite, e.g., carbon black or equally finely divided metals or metallic carbides, in a binder; and that the specific resistance of the particle:binder mixture may be varied by changing the amount and kind of electrically conductive particles used. It teaches also that the mixture may be sprayed or brushed onto a variety of different substrate materials.

A copper electrode 22, typically 0.32 cm. ($\frac{1}{8}$ in.) wide and 0.005 cm. (0.002 in.) thick, is placed on top of each longitudinal stripe 14. Electrodes 22 are slit from thin copper sheets and, as a result, are slightly curved and have sharp "points" at either side. The electrodes are mounted on stripes 14 with their convex surfaces facing up and the "points" along the edges facing down into and engaging stripes 14. This is most clearly shown in FIG. 2, in which the amount of curvature and size of the "points" of the electrodes is exaggerated for clarity. For long heaters, it is often desirable to increase the thickness of electrodes 22 to 0.01 cm. (0.004 in.) or so to increase their current carrying capacity.

It will be noted that stripes 14 are wider than either bars 18 or the spaces 20 between adjacent bars. This, coupled with the greater thickness of the stripes relative to the bar (e.g., a stripe thickness of about 1.4 times the bar thickness), reduces the interface resistance from the copper electrodes 22 to the bars 18.

Substrate 12, the graphite pattern (stripes 14 and bars 18) printed thereon and electrodes 22 are hermetically sealed between a pair of thin plastic sheets 23, 24. Each of sheets 23, 24 is a co-lamination of a 0.005 cm. (0.002 in.) thick polyester ("Mylar") dielectric insulator 23*a*, 24*a* and a 0.007 cm. (0.003 in.) thick adhesive binder, 23*b*, 24*b*, typically polyethylene. Plastic adheres poorly to graphite, but the polyethylene sheets 23*b*, 24*b* bond well to substrate 12 and to each other. In particular, the polyethylene sheet 23*b* on top of substrate 12 is bonded both to the uncoated paper boundary 16 outside stripes 14 and, on the inside of electrodes 22, to the uncoated paper spaces 20 between adjacent bars 18. Sheet 23*b* thus holds the electrodes 22 slightly in place against stripes 14. The electrode-to-graphite engagement is further enhanced by shrinkage of plastic sheets 23, 24 during cooling after lamination. Sheets 23, 24 are 0.64 cm. ($\frac{1}{4}$ in.) wider than substrate 12 and are sealed to each other outside the longitudinal edges of substrate 12, providing the desired hermetric seal. It will be noted that stripes 14 are slightly wider than electrodes 22. This extra width is desirable because of manufacturing tolerances to insure that the electrode always fully engages an underlying stripe. However, the extra width should be kept to a minimum to insure that the distance between the uncoated substrate boundary 16 and spaced to which the plastic sheet 23 overlying the electrodes is bonded is as short as possible.

Electric leads 28 connect heater 10 to a source of power 26. As shown, each lead 28 includes a crimp-on connector 30 having pins which pierce the plastic sheets 23, 24 and engage one of electrodes 22.

The resistance of silk-screened semi-conductor pattern (typically over 1000 ohms/square) is much greater than that of the copper electrodes 22 (typically less than 0.001 ohms per square); and it will thus be seen that the watt density (i.e., the wattage per linear foot of heater 10 depends primarily on the length, width and number of bars 18. Mathematically, the watt density (WD), i.e. W/UL, or watts per unit length (e.g., meter, foot, etc.), can be expressed as:

$$WD = \frac{v^2 n}{NbR}$$

where V is the potential difference in volts between the two copper electrodes, n is the number of bars 18 per unit length of tape, N is the inverse of the width of a bar 18, b is the center line length of a bar 18, and R is the resistance of the portion of the printed semi-conductor (e.g., graphite) pattern forming bars 18 in ohms per square.

The space 20 between the bars 18 of the semi-conductor pattern provide at least three functions: they provide graphite-free areas at which the plastic sheet 23 or other sealing layer holding electrodes 22 in engagement with stripes 14 may be bonded to the substrate 12; they permit the bars 12 to be oriented at any desired angle relative to the electrodes 22 and stripes 14; and, since a length of stripe 14 equal to the sum of (i) the width of a bar 18 plus (ii) the width of a space 20 is provided at each end of each bar, they increase the electrode-to-semi-conductor contact area for the bars.

Referring now to FIGS. 4A–4C, there are illustrated three substrates 12*a*, 12*b*, 12*c*, each carrying a respective graphite semi-conductor pattern, designated 11*a*, 11*b*, 11*c*, respectively. The stripes 14*a*, 14*b*, 14*c*, and the bars 18*a*, 18*b*, 18*c* of each pattern are, respectively of the same width and thickness; and the spaces 20*a*, 20*b*, 20*c* between adjacent bars and the distances between stripes 14 are the same also. The only difference between the three substrates is the angle, $\alpha$, at which the bars 18 are oriented relative to the stripes 14, or more particularly to a line extending perpendicularly between the stripes. On substrate 12*a*, the bars are perpendicular to the stripes (i.e., $\alpha=0°$); on substrate 12*b*, the angle $\alpha_b$ is equal to 45°; and the angle $\alpha_c$ on substrate 12*c* is equal to 60°. On each of the three substrates, the portion of the graphite semi-conductor pattern forming the bars 18 is printed on the substrate at a resistance of 2875 ohms per square; the two stripes 14 are 2.54 cm. (1 inch apart); and, as with the substrate 12 of heater 10, each bar 18*a*, 18*b*, 18*c* is 0.64 cm. ($\frac{1}{4}$ in.) wide, and the space between adjacent bars 18 is 0.32 cm. ($\frac{1}{8}$ in.) wide.

Using the formula provided above, it will be seen that a heater using substrate 12*a* will have a watt density of 130 watts per meter (40 watts per linear foot); while the watt densities of heaters using substrates 12*b* and 12*c* will be, respectively, 65 amd 32.5 watts per meter (20 and 10 watts per linear foot). In each instance, it will of course be recognized that this is the watt density for the portion of the heater in which the bars 18 extend between and are electrically connected to the stripes 14, and does not include the short distance at each end of a heater in which, if the bars are not perpendicular to the stripes, there are a few bars that are not so connected.

FIG. 5 shows a modified heater 110 in which the graphite semiconductor pattern is printed on a polyethylene substrate 112 and includes more than two (as shown over 4) longitudinal stripes 114 each underlying and engaging an electrode 122. A set of bars 118 extends between each pair of stripes 114, and as before each bar 118 is wider than the open (no graphite) space 120 between adjacent bars 118. All of the bars 118 are at angle of 45° to stripes 114; and, as before, the bars 118 are printed on $\frac{2}{3}$ of the substrate area between stripes 114, leaving $\frac{1}{3}$ of the space for bonding. In the FIG. 5 embodiment, however, bars 118 are not solid. Rather, each bar comprises six thin (0.04 cm. or about 0.015 in.) parallel graphite lines spaced 0.08 cm. (about 0.030 in.) apart. The overall width of each bar 118 is about 0.64 cm. ($\frac{1}{4}$ in.) and the spaces 120 between bars 118 are 0.32 cm. ($\frac{1}{8}$ in.) wide. The distance between the thin lines forming each bar 118 is such that the heat radiates into the void between adjacent lines.

The multi-line bar design of the FIG. 5 embodiment is especially useful when the resistivity of the semi-conductor graphite material is such that a solid bar would be more conductive than desired. The multi-stripe and electrode design of the FIG. 5 embodiment is used when the overall width of the heater is such that a continuous bar 118 extending substantially the full width of the heater would have a greater resistance than desired.

In the FIG. 5 embodiment, each of electrodes 122 is held in place by a discrete relatively narrow piece of plastic 123 (e.g., polyethylene) that overlies the particular electrode 122 and is sealed to the plastic substrate 112 at the spaces 120 (or in the case of the electrodes at the edge of the heater to the spaces 120 and boundary 116) on either side of the stripe 114 underlying the particular electrode. As will be seen, the FIG. 5 design greatly reduces the amount of plastic required, and thus reduces the cost of the heater; but the lack of a complete hermetric seal can limit the environments in which the heater an be used. In other embodiments, the electrodes may be held in tight engagement with the substrate by, e.g., thermoset resins, elastomers, or other laminating materials. The amount of plastic required can be further reduced by using a paper rather than a plastic substrate.

The heater 202 shown in FIG. 6, in which the graphite pattern includes areas 204 about 15 cm. (6 in.) long which include bars 206 interrupted by spaces 208 of equal length on which no bars are printed, is especially suited for greenhouses. A pot containing seeds or seedlings may be placed on each space 204, but no power will be wasted heating the spaces 208 between pots. As will be seen, the bars 206 in the FIG. 6 embodiment are printed so that all the bars in each area 204 extend between and are electrically connected to stripes 209.

Figure 7:
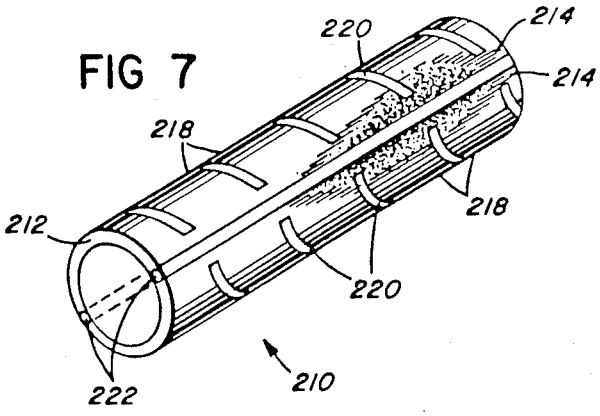
FIG. 7 is a perspective view of a second heater including the invention.

FIG. 7 illustrates a tubular member 210 having a plastic base 212 in which is embedded (or, alternatively, are placed thereon) a pair of elongated parallel electrodes 222 at 180° with respect to each other. The colloidal graphite pattern is printed on base 212 with bars 218 extending helically between longitudinal stripes 214 along each edge of electrodes 222.

Figure 8:
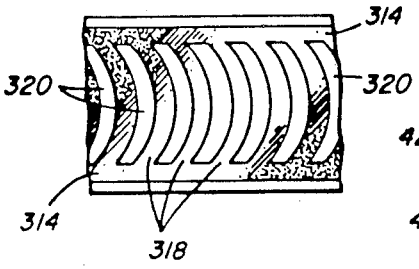
FIGS. 8–11 are diagrammatic views illustrating alternative forms of semi-conductor patterns for heaters embodying the invention.
Figure 9:
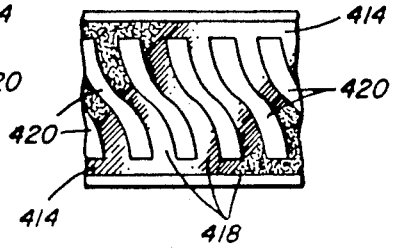
Figure 10:
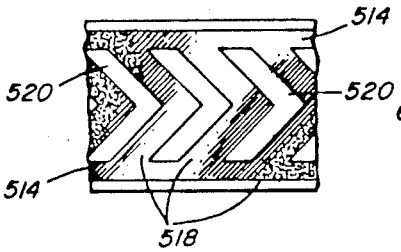
Figure 11:
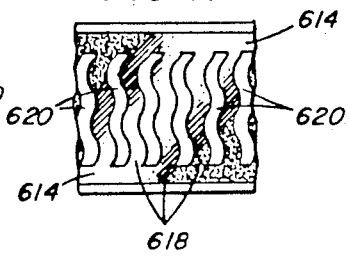

Referring now to FIGS. 8–11 there are shown other graphite patterns that may be used with the heaters of FIGS. 1, 5 and 7. Each pattern includes a pair of parallel longitudinally-extending stripes, 314, 414, 514, 614, and a plurality of identical bars 318, 418, 518, 618 extending therebetween. In each instance, the bars are at least as wide as the spaces 320, 420, 520, 620 between adjacent bars and are narrower than stripes 314, 414, 514, 614; and each bar is longer than the perpendicular distance between the two stripes it connects. In FIG. 8, the bars 318 are smooth arcs; the bars 418 in FIG. 9 are S-shaped or reverse curves; the FIG. 10 heater has bars 518 in the shape of chevrons; and the bars 618 of the FIG. 11 heaters are curved with multiple points of inflection. In each design, typically, the stripes are thicker than the bars.

What is claimed is:

1. An electrical heating device comprising:

a substrate having an electrically insulating surface a semi-conductor pattern carried on said electrically insulating surface of said substrate, said pattern including a pair of generally continuous stripes extending generally parallel to and spaced apart from each other, and a plurality of regularly spaced bars extending between and electrically connected to said stripes, said bars and stripes being arranged so as to provide portions of said substrate at inside edges of said stripes and intermediate adjacent ones of said bars that are free from said semi-conductor pattern; and a pair of elongated sheet metal conductors having a resistivity less than that of said bars, each of said conductors being in face-to-face direct electrical engagement with portions of one of said pair of stripes that abut an end of each of said bars and the portions of said one stripe intermediate the ends of adjacent one of said bars.

2. The electrical heating device of claim 1 wherein each of said conductors engages a side of said pattern facing away from said substrate.

3. The electrical heating device of claim 1 wherein said bars are of substantially uniform thickness, said stripes are of substantially uniform thickness, and the thickness of said stripes is greater than that of said bars.

4. The electrical heating device of claim 1 wherein said semi-conductor pattern comprises colloidal graphite and a binder.

5. The heating device of claim 1 wherein a width of each of said bars is about twice as great as a width of a space between adjacent ones of said bars.

6. The electrical heating device of claim 1 wherein the length of junctions between the ends of said bars and longitudinally-extending edges of said stripes, measured parallel to said stripes, is not more than about $\frac{1}{2}$ inch.

7. The electrical heating device of claim 6 wherein said distance is in a range of about $\frac{1}{4}$ to $\frac{1}{2}$ inch.

8. The electrical heating device of claim 1 wherein the area of said substrate covered by said bars is about twice the area of said portions of said substrate that are free from said semiconductor pattern.

9. The electrical heating device of claim 1 wherein the width of each of said bars, measured longitudinally of said device, is in a range of about $\frac{1}{4}$ inch to not more than about $\frac{1}{2}$ inch.

10. The electrical heating device of claim 9 wherein the width of each of said portions of said substrate that are free from said semi-conductor material, measured longitudinally of said device, is not more than about $\frac{1}{4}$ inch.

11. An electrical heating device comprising:

a substrate having an electrically insulating surface a semi-conductor pattern carried on said electrically insulating surface of said substrate, said pattern including a pair of generally continuous stripes extending longitudinally of said device generally parallel to and spaced apart from each other, and a plurality of bars regularly spaced from each other and extending between and electrically connected to said stripes, said bars and stripes being arranged so as to provide portions of said substrate extending transversely of said device from an inside edge of one of said stripes to an inside edge of an other of said stripes and intermediate adjacent ones of said bars that are free from said semi-conductor pattern, each of said bars having a width, measured longitudinally of said device, of not more than about $\frac{1}{2}$ inch; and, a pair of elongated sheet metal conductors having a resistivity less than that of said bars, each of said conductors being in face-to-face direct electrical engagement with one of said pair of stripes both at portions of said one stripe abutting ends of each of said bars and at portions of said one stripe intermediate the ends of adjacent ones of said bars, each of said conductors having a width, measured transversely of said device, not greater than a width of the stripe with which it is in face-to-face contact and being located, transversely of said device, between side edges of the said stripe with which it is in face-to-face contact.

12. The electrical heating device of claim 11 wherein each of said portions that are free from said semi-conductor pattern has a width, measured longitudinally of said device, not more than about $\frac{1}{4}$ inch.

13. The electrical heating device of claim 11 wherein the area of said substrate covered by said bars is about twice the area of said portions of said substrate that are free from said semiconductor pattern.

* * * * *